US006779228B2

(12) United States Patent
Plomteux et al.

(10) Patent No.: US 6,779,228 B2
(45) Date of Patent: Aug. 24, 2004

(54) QUIET CENTRAL VACUUM POWER UNIT

(76) Inventors: Alexandre Plomteux, 5890, De la Roche, Montreal, Quebec (CA), H27 2C7; Reynald Bizier, 72, Croissant Agathe, St-Joseph-du-Lac, Quebec (CA), J0N 1M0; Jacques Cloutier, 206, Colbert, Le Gardeur, Quebec (CA), J5Z 4J9

( * ) Notice: Subject to any disclaimer, the term of this patent is extended or adjusted under 35 U.S.C. 154(b) by 196 days.

(21) Appl. No.: 10/057,750

(22) Filed: Jan. 24, 2002

(65) Prior Publication Data

US 2002/0178531 A1 Dec. 5, 2002

(30) Foreign Application Priority Data

Jan. 24, 2001 (CA) ..... 2332195

(51) Int. Cl.[7] ..... A47L 5/38
(52) U.S. Cl. ..... 15/326; 15/314; 15/327.6
(58) Field of Search ..... 15/314, 315, 326, 15/327.6, 413

(56) References Cited

U.S. PATENT DOCUMENTS

| | | | | |
|---|---|---|---|---|
| 1,083,408 | A | | 1/1914 | Matchette |
| 1,765,784 | A | | 6/1930 | Aldinger |
| 1,903,855 | A | | 4/1933 | Townsend |
| 2,030,366 | A | | 2/1936 | Grave |
| 2,155,669 | A | | 4/1939 | Lofgren |
| 2,272,985 | A | | 2/1942 | Smith |
| 2,281,858 | A | | 5/1942 | Pierce |
| 2,327,553 | A | | 8/1943 | Ponselle |
| 2,330,701 | A | | 9/1943 | Gerber |
| 2,884,185 | A | | 4/1959 | Dolan |
| 2,962,118 | A | | 11/1960 | Lee et al. |
| 3,213,480 | A | * | 10/1965 | MIller ..... 15/314 |
| 3,218,783 | A | | 11/1965 | Ripple |
| 3,308,608 | A | | 3/1967 | Brimberg |
| 3,358,316 | A | | 12/1967 | Okun |
| 3,599,273 | A | | 8/1971 | Shirayanagi et al. |
| 3,609,946 | A | | 10/1971 | Nakagawa et al. |
| 4,120,616 | A | | 10/1978 | Dwyer et al. |
| 4,280,245 | A | | 7/1981 | Hiester |
| 4,330,899 | A | | 5/1982 | Miller et al. |
| 4,356,591 | A | | 11/1982 | Lude |
| 4,418,443 | A | | 12/1983 | Fischer |
| 4,435,877 | A | | 3/1984 | Berfield |
| 4,443,235 | A | | 4/1984 | Brenholt et al. |

(List continued on next page.)

FOREIGN PATENT DOCUMENTS

| | | |
|---|---|---|
| CA | 1323145 | 10/1993 |
| CA | 2115700 | 11/1995 |
| CA | 2200559 | 5/1996 |
| CA | 2191049 | 5/1997 |
| DE | 3402603 A1 | 8/1985 |
| DE | 3502239 A1 | 7/1986 |
| DE | 19843719 | 4/1999 |
| EP | 0 453 163 A1 | 10/1991 |
| EP | 0 636 336 A1 | 2/1995 |
| EP | 0 888 742 A1 | 1/1999 |
| JP | 56005623 | 1/1981 |
| SU | 1768135 | 10/1992 |
| WO | PCT WO 95/13736 | 5/1995 |
| WO | PCT WO 00/30521 | 6/2000 |

*Primary Examiner*—Theresa T. Snider

(57) ABSTRACT

The present invention relates to a central vacuum power unit comprising in combination a canister, a chamber for collecting debris, a first plate, a second plate, a third plate, a duct, a motor-fan assembly, a filter, and a first baffle. The duct extends between the first and second plates and is in fluid flow communication with respective openings defined in the first and second plates. The sidewall of the canister, the first and the second plates and the duct defines an acoustic damping chamber covered with a lining of sound absorbing material.

20 Claims, 9 Drawing Sheets

U.S. PATENT DOCUMENTS

| | | | |
|---|---|---|---|
| 4,512,713 | A | 4/1985 | Berfield |
| 4,533,370 | A | 8/1985 | Ikezaki et al. |
| 4,655,694 | A | 4/1987 | Berfield |
| 4,665,581 | A | 5/1987 | Oberdorfer |
| 4,706,326 | A | 11/1987 | Romani |
| 4,735,555 | A | 4/1988 | Erickson |
| 4,759,422 | A | 7/1988 | Belley |
| 4,773,118 | A | 9/1988 | Lindquist et al. |
| 4,797,072 | A | 1/1989 | Berfield et al. |
| 4,938,309 | A | 7/1990 | Emdy |
| 4,970,753 | A | 11/1990 | Herron, Jr. |
| 5,155,876 | A | 10/1992 | Whitaker |
| 5,159,738 | A | 11/1992 | Sunagawa et al. |
| 5,289,612 | A | 3/1994 | Glenn, III |
| 5,293,664 | A | 3/1994 | Lim et al. |
| 5,353,469 | A | 10/1994 | Fellhauer |
| 5,365,633 | A | 11/1994 | Sunagawa et al. |
| 5,369,839 | A | * 12/1994 | Worwag ..... 15/327.6 |
| 5,400,463 | A | 3/1995 | Attard et al. |
| 5,457,846 | A | 10/1995 | Kuwano et al. |
| 5,471,707 | A | 12/1995 | Kang |
| 5,502,869 | A | 4/1996 | Smith et al. |
| 5,513,417 | A | 5/1996 | Kim et al. |
| 5,647,570 | A | 7/1997 | Berfield et al. |
| 5,720,074 | A | 2/1998 | Lee |
| 5,737,797 | A | 4/1998 | Rittmueller et al. |
| 5,765,257 | A | 6/1998 | Steger et al. |
| 5,813,085 | A | 9/1998 | Fritz et al. |
| 5,894,629 | A | 4/1999 | Kim |
| 6,003,200 | A | 12/1999 | Potts et al. |
| 6,052,863 | A | 4/2000 | Rittmueller et al. |
| 6,094,774 | A | 8/2000 | Larsen et al. |
| 6,158,083 | A | 12/2000 | Holsten |

* cited by examiner

QUIET CENTRAL VACUUM POWER UNIT

FIELD OF THE INVENTION

The invention relates to a central vacuum power unit and more particularly to a central vacuum power unit allowing to substantially reduce the level of noise emitted.

DESCRIPTION OF THE PRIOR ART

A central vacuum cleaner comprises a power unit usually installed permanently in an area of a building and one or more ducts are connected to vacuum system intlets provided in various zone all over said building. Said cleaner allows to clean any areas of said building with the use of a flexible hose or other debris recuperation device connected to said intlets. Said central vacuum power unit can be activated by mere insertion of the hose in one of saids inlets which is electrically wire to said unit, or by a switch provided on the hose or in the debris recuperation device, or by any other means.

Because habitable surfaces in recent buildings are optimized, a central vacuum power unit is frequently installed near a living space. However, said power unit generates high levels of noise. Therefore, it is necessary to make said power unit as quiet as possible. The prior art reveals the use of opened cells polyurethane foam inside a canister of a vacuum cleaner, as sound absorbing material, the use of a muffler at the outlet of the working air; the flowing of sound through a tortuous passageway to generate sound reflection against sound absorbing material, the mounting of a motor on a seat made of vibration absorbing material, ect. Even with those characteristics intended to reduce the levels of noise emitted by existing central vacuum power unit, there is still a strong need for a more quiet central vacuum power unit for central vacuum cleaner.

More particularly, the prior art central vacuum power units suggest for reducing the level of noise generated at a vacuum air exhaust, to mount a straight silencer (muffler) to said exhaust of the working air. Preferably, it may be advantageous to provide an elbow between the an exhaust and the silencer to redirect the exhaust from a horizontal to a vertical direction and thereby to take less horizontal space (which is normally what is paid for in a building, ($/sq.ft)). Two problems arise in the prior art:

- The use of a straight silencer fails to generate a sufficient amount of reflexion of said noise against a sound absorbing material and therefore a substantial level of noise is still emitted outside the central vacuum power unit.
- The positioning of an elbow outside a canister of said central vacuum power unit creates an abrupt change in air direction that generates noise that is transmitted throught the sidewall of the elbow. This noise is not dampened in existing central vacuum power unit. Especially, when a tangential fan is used, the level of noise generated in the area of the elbow is important. Therefore, there is still a strong need fo find a simple and efficient way to reduce this prior art noise problem, especially to reach noise level lower than those of the existing prior art central vacuum power unit It is to be noted that to seal leaks of noise originating from the opening around the working air exhaust, it is not possible to have a seal having at once no noises leaks and substantial surface properties (to block the noise) while remaining flexible. A more dense seal is generally less flexible. However, it is important to maintain the flexibility properties to avoid a rigid contact of the working air exhaust with the canister to avoid vibration and generating additional noise.

More particularly, said noise in the area of said elbow appears to have three origines, that is:

- Opening around the fan outlet. Indeed, it was noted that even a very small opening will let considerable amount of noise escaping from the canister. Also, any vertical movement of the motor-fan assembly due to the vacuum underneath said assembly, contribute to increase the risk of having a solid contact with a structural part of the power unit to thereby transmit vibrations to said structure and generate additional noises (i.e. sound moves through the structure of the canister toward the outside)
- Turbulence generated in said elbow (toward the outlet of the silencer). The zone of turbulence being near said silencer, the possibility of contact of the noise with a sound absorbing material is lowered.
- Turbulence generated in the elbow (across the sidewall of the elbow) Standard elbow available in the industry are not provided with sound insulation and are generally made of light material such as polyvinyl chloride (PVC). They will let substantial amount of noise to propagate across its sidewall. Said sidewall has a low surface density and has low sound dampening properties.

It has now been discovered that the level of noises emitted by a central vacuum power unit for a central vacuum cleaner can be lowered, and preferably without affecting the efficiency and useful life of said power unit.

SUMMARY OF THE INVENTION

Advantageously, the present invention relates to a new central vacuum power unit, especially for a central vacuum cleaning system, said central vacuum power unit emitting substantially low level of noise outside in the surrounding environment Preferably, said level of noise are lower than those noted with existing central vacuum power unit Advantageously, the present invention relates to a new central vacuum power unit, especially for a central vacuum cleaning system, in which the working air and noise (preferably at the fan exhaust) is subjected to at least one change of direction inside an acoustic dampening chamber, preferably to increase the amount of reflexions of the noise against sound absorbing material provided inside said acoustic dampening chamber.

Advantageously, the present invention relates to a new central vacuum power unit, especially for a central vacuum cleaning system, in which it is not necessary to use any outer silencer (muffler) or an elbow-silencer assembly at the working air exhaust of the power unit.

Advantageously, the present invention relates to a new central vacuum power unit, especially for a central vacuum cleaning system, that is simple, reliable and economical to manufacture Advantageously, the present invention relates to a new central vacuum power unit, especially for a central vacuum cleaning system, that is very easy to install on a wall.

Advantageously, the present invention relates to a new central vacuum power unit, especially for a central vacuum cleaning system, in which the vacuum is a tangential vacuum fan, especially of the type having an axial air intake and a tangential air exhaust. Preferably, such a vacuum fan allow to generate an important vacuum and an important flow of working air According to a particularly prefered embodiment of the invention, it has been surprisingly found that all important reduction of the level of noise emitted by a central vacuum power unit is obtained when the assembly is not positioned in the center of the canister, when the outlet of the fan enters a substantially annular acoustic dampening chamber and when the noise originating from the vacuum tangential fan has a change of direction and several absorption against a lining of sound absorbing material provided in said substantially annular acoustic dampening chamber.

According to another particularly preferred embodiment of the invention, means are provided to avoid the plate supporting the motor-fan assembly to tilt under the force resulting of the presence of a vacuum underneath the motor-fan assembly.

According to another particularly preferred embodiment of the invention, the motor-fan assembly and the piping at ist outlet do not have solid contact with the plate and/or canister supporting it, to thus prevent the transmission of vibration through the structure of the central vacuum power unit and thereby the gereration of noise.

According to another particularly preferred embodiment of the invention, the motor-fan assembly is centered to rest freely on a seat of vibration absorbing material thanks to a ring of vibration absorbing material retained in place by a ring of solid material making an integral part of the plate supporting the motor-fan assembly.

More particularly, the present invention relates to central vacuum power unit comprising in combination a canister, a chamber for collecting debris, a first plate, a second plate, a third plate, a duct means, a motor-fan assembly, a filtering means, a first baffle means, means for generating a flow of cooling air for an electric motor, and means for reducing the emission of noise outside the canister.

The canister has a sidewall and a hollow interior. The chamber for collecting debris may be in fluid communication with an inlet (preferably provided with an inlet) for a working air loaded with debris. The first plate extends across said hollow interior, is mounted to said sidewall and is provided with a first opening.

The second plate extends across the hollow interior and is provided with a first opening. The third plate extends across the hollow interior and is provided with a first opening. The duct means has a sidewall, a hollow interior, a first end and a second end. The first end is mounted on the first plate and has the hollow interior of said duct means in fluid communication with the first opening of the first plate. The second end is mounted to the second plate and has the hollow interior of the duct means in fluid communication with the first opening of said second plate. Said duct means supports the second plate above the first plate. The first plate and the second plate define with the sidewall of the canister and the sidewall of the duct means an acoustic dampening chamber. This acoustic dampening chamber is further provided with a lining of sound absorbing material and with an outlet in the sidewall of the canister.

The motor-fan assembly emitting noises and vibrations, rests freely against a seat made of resilient vibration absorbing material and is mounted on the third plate. Said motor-fan assembly comprises an electric motor, a vacuum fan provided with an axial intake in fluid communication with the chamber for collecting debris, a tangential outlet and a piping having a first end in fluid communication with said tangential outlet, and a second end in fluid communication with the inside of the acoustic chamber. Said motor-fan assembly generates a flow of working air from the inlet of the chamber for collecting, debris to the outlet of the acoustic dampening chamber.

Preferably, at the exhaust of the vacuum fan, an elbow, preferably facing downward, is placed to redirect the airflow to the substantially dampening acoustic dampening chamber. However, this substantially annular acoustic dampening chamber could be at any location, adjacent or not, to the motor-fan assembly.

The filtering means is positioned between the chamber for collecting debris and the air intake of the vacuum fan.

The first baffle means is provided inside the acoustic dampening chamber and is positioned to reduce direct motion delivered from the second end of the piping to the outlet of the chamber The central vacuum power unit is advantageously characterized in that a portion of said piping passes across a further opening is provided in the plate which is provided with the seat of resilient vibration dampening material and is receiving the motor-fan assembly, in that said portion of piping has a vertical axis substantially parallel to the axis of the intake of the vacuum fan, so that any deformation of the seat due to the vacuum existing underneath the motor-fan assembly will allow the piping to slide freely in said further opening without solid contact with said plate.

According to a particularly preferred embodiment, the electric motor is further provided with a cooling fan forcing a flow of cooling air from one end of the electric motor to an opposite end of said motor, and said canister is further provided with a fourth plate extending across the hollow interior of the canister above the third plate, and a fifth plate extending across the hollow interior of the canister above the fourth plate. The fourth plate and the fifth plate define with the sidewall of the canister, a first chamber in fluid communication with a first opening provided in the sidewall of said canister and defining an inlet for the cooling air for the electric motor and a second opening across which a portion of a casing of said electric motor is engaged. The third plate and the fourth plate define with the sidewall of the canister a second chamber for the cooling air coming out the electric motor and evacuated outside the canister through an opening provided in the sidewall of the canister and in fluid communication with said second chamber According to various embodiments of the invention, either the first plate and the third plate define the same plate, or the first plate and the fifth plate defines the same plate.

According to a more particularly preferred embodiment, the invention relates to a central vacuum power unit comprising in combination a canister, a debris collection chamber, a first plate, a second plate, a duct means, a filtering means, a motor-fan assembly, a first baffle means, means for generating a flow of cooling air for an electric motor, and means for reducing the emission of noise origination from the generation of said cooling air, outside the canister.

The canister has a sidewall and a hollow interior. The debris collection chamber is provided with an inlet for a working air loaded with debris. The first plate extends across said hollow interior, is mounted to said sidewall and is provided with a first opening. The second plate extends across the hollow interior and is provided with a first opening and a second opening.

The duct means has a sidewall, a hollow interior, a first end and a second end. The first end is mounted on the first plate and has the hollow interior of said duct means in fluid communication with the first opening of the first plate. The second end is mounted to the second plate and has the hollow interior of the duct means in fluid communication with the first opening of said second plate. Said duct means supports the second plate above the first plate. The first plate and the second plate define with the sidewall of the canister and the sidewall of the duct means an acoustic dampening chamber which is further provided with a lining of sound absorbing material and with an outlet in the sidewall of the canister.

The filtering means is positioned between the debris collection chamber and the duct means The motor-fan assembly emits noises and vibrations rests freely against a seat made of resilient vibration absorbing material and is mounted on the second plate around the first opening of said second plate. Said motor-fan assembly comprises an electric motor, a vacuum fan provided with an axial intake in fluid communication with the first opening of the second plate, a tangential outlet and a piping having a first end in fluid communication with said tangential outlet, and a second end in fluid communication with the inside of the acoustic dampening chamber Said motor-fan assembly generates a flow of working air from the inlet of the debris collection chamber to the outlet of the acoustic dampening chamber.

The first baffle means is provided inside the acoustic dampening chamber and is positioned to prevent direct motion of noise delivered from the second end of the piping to the outlet of the acoustic dampening chamber.

Preferably, the central vacuum power unit according to the invention is characterized in that a portion of said piping passes across the second opening of the second plate and has a vertical axis substantially parallel to the axis of the intake of the vacuum fan, so that any deformation of the seat due to the vacuum existing underneath the motor-fan assembly will allow the piping to slide freely in the second opening of the second plate without solid contact with said second plate. Preferably, the deformation and the motion are substantially vertical.

Advantageously, there is a pathway between the outlet of the piping and the outlet of the acoustic dampening chamber that represents a portion of circle. Preferably, said pathway is substantially annular.

Preferably, the duct means has a substantially vertical passage between its first end and its second end, the first end being substantially co-axial with the first opening of the first plate, the second end being parallel and not aligned with the first opening of the second plate Preferably, the acoustic dampening chamber and first baffle are completely provided with a lining of sound absorbing material.

Preferably, a sleeve of resilient vibration absorbing material is mounted around the second opening of the second plate. Said sleeve may have an interior of such size and orientation to allow a free axial sliding of said portion of the piping passing across the second opening of said second plate while substantially preventing leak of working air and noise from the acoustic dampening chamber. Advantageously, said sleeve may be mounted on an upper side of said second plate. More preferably, said sleeve is mounted by gluing.

Preferably, the electric motor may be further provided with a cooling fan forcing a flow of cooling air from one end of the electric motor to an opposite end of said motor, and said canister may be further provided with a fourth plate extending across the hollow interior of the canister above the second plate, and a fifth plate extending across the hollow interior of the canister above the fourth plate. The fourth plate and the fifth plate define with the sidewall of the canister a first chamber in fluid communication with a first opening provided in the sidewall of the canister and defining an inlet for the cooling air for the electric motor and a second opening across which a portion of a casing of said electric motor is engaged The second plate and the fourth plate define with the sidewall of the canister a second chamber for the cooling air coming out the electric motor and evacuated outside the canister through an opening provided in the sidewall of the canister and in fluid communication with said second chamber.

Advantageously, the fourth plate may be sat on a portion of the sidewall of the canister projecting toward the hollow interior, in order to position it above said second plate Advantageously, the fifth plate may be a cover adapted to close one end of the canister.

Preferably, a set of second baffles may be further provided between the inlet opening of the canister and the second opening of the fourth plate. Advantageously, said second baffles are provided with a lining of a sound absorbing material.

Preferably, the second chamber may be provided with a lining of sound absorbing material.

Preferably, the inlet of the second chamber and the outlet of the third chamber may be each provided with an outer muffler provided with a lining of sound absorbing material therein. Advantageously, both mufflers may be provided in a hollow member having parallel conduits, each conduit being in fluid communication with the exterior of the canister at opposite ends of said member, and being respectively in fluid communication with the inlet of the first chamber and the outlet of the second member.

Preferably, said hollow member may be further provided with means for hanging the central power unit to a wall.

BRIEF DESCRIPTION OF THE DRAWINGS

Particularly preferred embodiments of the invention will be described hereinafter with reference to the following drawings.

DETAILED DESCRIPTION OF PARTICULARLY PREFERRED EMBODIMENTS

Figure 1:
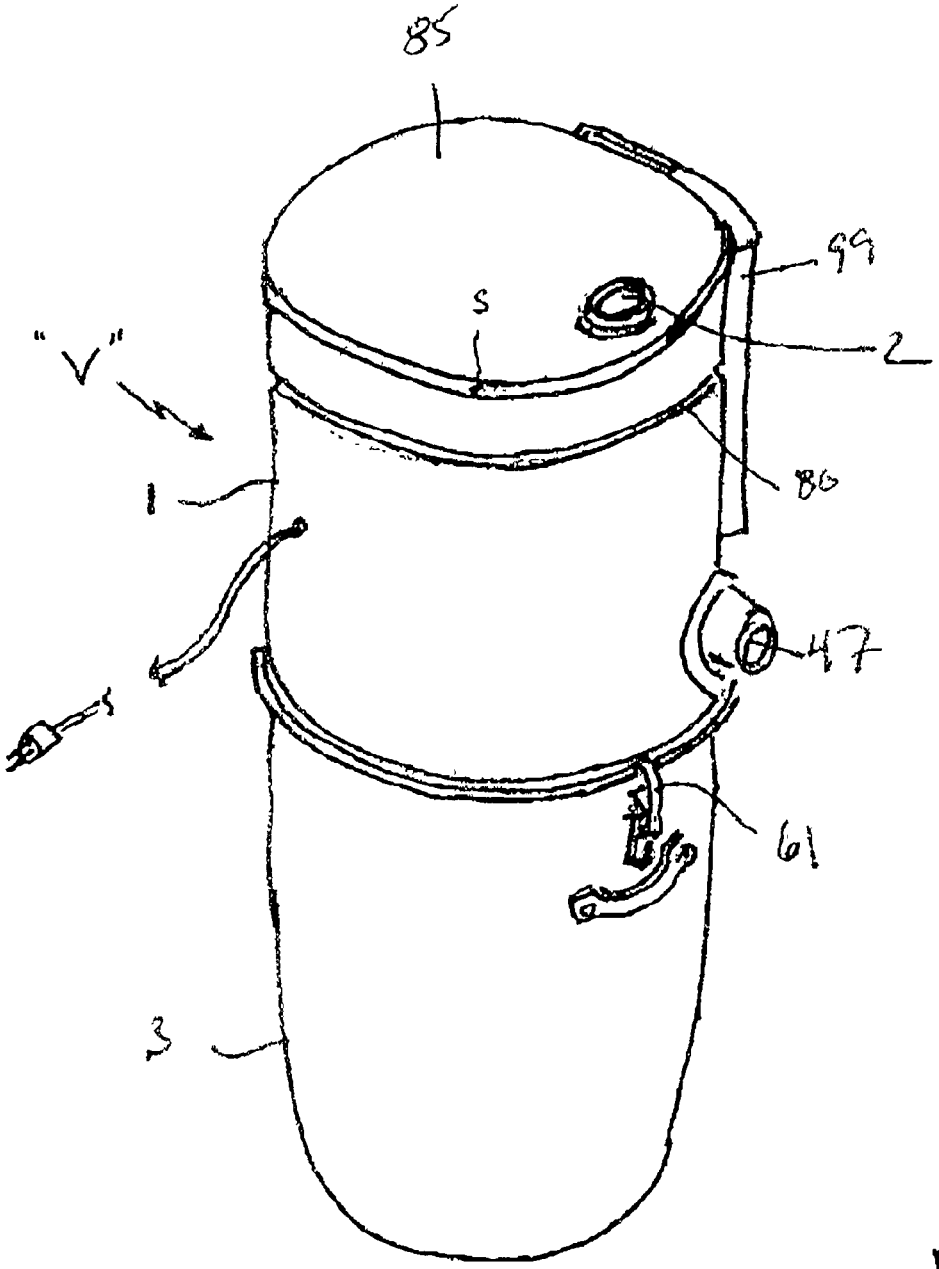
FIG. 1 is a is a perspective view of a central vacuum power unit according to the invention
Figure 2:
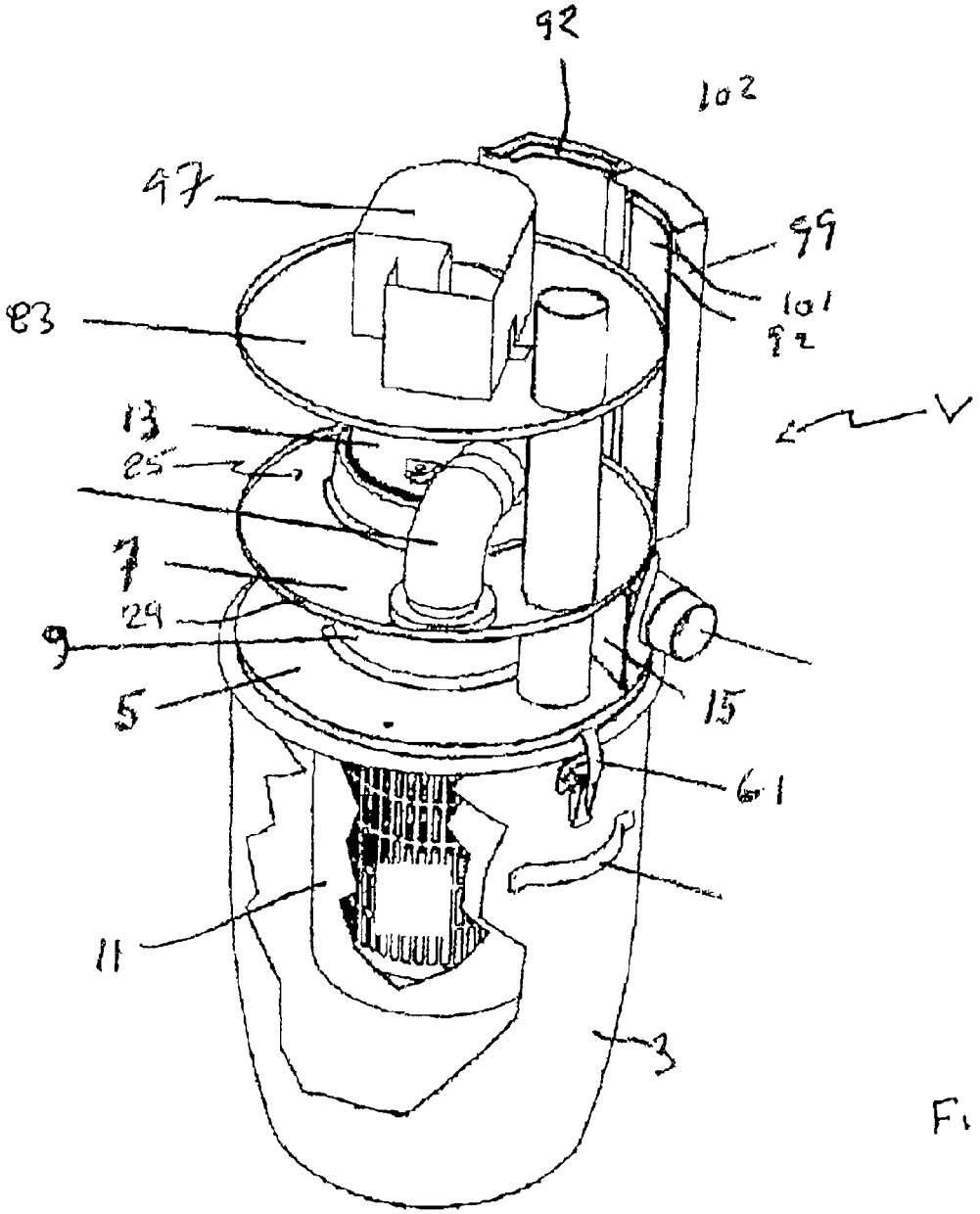
FIG. 2 is a partial perspective view of the central vacuum power unit of FIG. 1, without the cover and the canister sidewall.

As illustrated in the drawings, the present invention preferably refers to a central vacuum power unit "V" comprising in combination a canister 1, a debris collection chamber 3, a first plate 5, a second plate 7, a duct means 9, a filtering means 11, a motor-fan assembly 13, a first baffle means 15, means 17 for generating a flow of cooling air for the electric motor 21. Advantageously, the debris collection chamber 3 is in fluid communication with an air intake 2 for the working air loaded with debris Optionally, this air intake may be in fluid communication with a tubing 4 positioned between said air intake and said debris collection chamber.

The canister 1 has a sidewall 23 and a hollow interior 25. The sidewall 23 may be advantageously made of any appropriate material such as for example from a sheet of steel or a sheet of aluminum. Preferably, as illustrated, the canister may have a cylindrical hollow interior 25.

The first plate 5 advantageously extends across said hollow interior 25 and is mounted to said sidewall 23 by any appropriate means well known to a main skill in the art (example by welding). Preferably, the first plate 5 is provided with a first opening 27. This plate 5 is advantageously of such size and shape to close one end of the canister 1. The second plate 7 advantageously extends across the hollow interior 25, is provided with a first opening 31 and a second opening 33 Plates 5 and 7 are made of any appropriate material, especially from a sheet of steel or a sheet of aluminum. Preferably, the plate 7 may be further provided with a flange 29 which contribute to improve the solidity of said plate 7 Advantageously, the flange 29 may be in contact with the sidewall 23.

The duct means 9 has a sidewall 35, a hollow interior 37, a first end 39 and a second end 41. The first end 39 is mounted on the first plate 5 and has the hollow interior 37 in fluid communication with the first opening 27 of the first plate 5. The second end 41 is mounted to the second plate 7 and has the hollow interior 37 of the duct means 9 in fluid communication with the first opening 31 of said second plate 7. Said duct means 9 supports the second plate 7 above the first plate 5. The first plate 5 and the second plate 7 define with the sidewall 23 of the canister and the sidewall 35 of the duct means 9 an acoustic dampening chamber 43*f*. This acoustic dampening chamber 43 may be further provided with a lining 44 of sound absorbing material and with an outlet 47 in the sidewall 23 of the canister 1.

The filtering means 11 is positioned between the debris collection chamber 3 and the duct means 9. As illustrated in the drawings, the filtering means may comprise a tubular support 49 provided with a plurality of openings 51, and a filter 53 The support 49 may be advantageously mounted underneath the first opening 27 of the plate 5 by any appropriate means. Preferably, a sleeve 50 is connected to the underneath of the plate 5 (by any appropriate means) and the support 49 is merely engaged in said sleeve by friction Of course, various kind of filtering means well known in the field of vacuum cleaner may be used in place of the support-filter assembly.

Advantageously, the debris collection chamber 3 may be a container 55 having an open top 57 and an upper edge 59 As illustrated, means may be provided for fastening the container 55 to the bottom of canister 1. Any appropriate means may be used, however it may be advantageous to use a pair of clip 61 Each clip 61 advantageously comprises a hook portion pivotally mounted on a lever itself pivotally mounted on a base fixed to the container 55 The hook portion engage a flange projecting outside the sidewall of the canister and press the edge 59 against a seal 60 positioned under the plate 5. The clip 61 is preferably made of metal The motor-fan assembly 13 emits noise and vibration, rests freely against a seat 14 made of resilient vibration absorbing material and is mounted on the second plate 7 around the first opening 31. Said motor-fan assembly 13 may advantageously comprise the electric motor 21, a vacuum fan 67 provided with an axial intake 69 in fluid communication with the first opening 31 of the second plate, a tangential outlet 71 and a piping 73 having a first end 75 in fluid communication with said tangential outlet 71, and a second end 77 in fluid communication with the inside of the acoustic dampening chamber 43. Said motor-fan assembly 13 generates a flow of working air from the inlet of the debris collection chamber 3 to the outlet 47 of the acoustic dampening chamber 43.

Preferably a ring 8 of resilient vibration absorbing material may be provided to contribute to center the motor-fan assembly on the seat. Advantageously, this ring may be retained against the second plate 7 with another ring (not shown) making an integral part of said plate 7. The motor fan assembly can move freely inside said ring 8. This ring only maintains the motor-fan assembly centered with respect to the seat 14.

Preferably, the piping 73 may only contact the lining 44 of the acoustic dampening chamber When such a contact occurs, the piping 73 may contribute to prevent undesired rotation of the motor-fan assembly especially when the motor is started.

Preferably, the piping 73 may consist of PVC pipes that are substantially rigid. However, it is also possible to use other material. Alternatively, piping that are flexible or semi-flexible may also be used.

The first baffle means 15 be provided inside the acoustic dampening chamber 43 and may be positioned to prevent direct motion of noise delivered from the second end 77 of the piping 73 to the outlet 47 of the acoustic dampening chamber 43 Advantageously, the baffle means 15 create a pathway between the outlet 77 of the piping 73 and the outlet 47 of the acoustic dampening chamber 43 that represents a portion of circle, more preferably a substantially annular pathway. Preferably, the acoustic dampening chamber 43 and first baffle means 15 are completely covered with a lining of sound absorbing material. Advantageously, the first baffle means may consist of a partition wall extending between plates 5 and 7 and sidewalls 23 and 35, and positioned between the end 77 and outlet 47. Advantageously, said partition wall is provided with a lining of sound insulating material.

Figure 7:
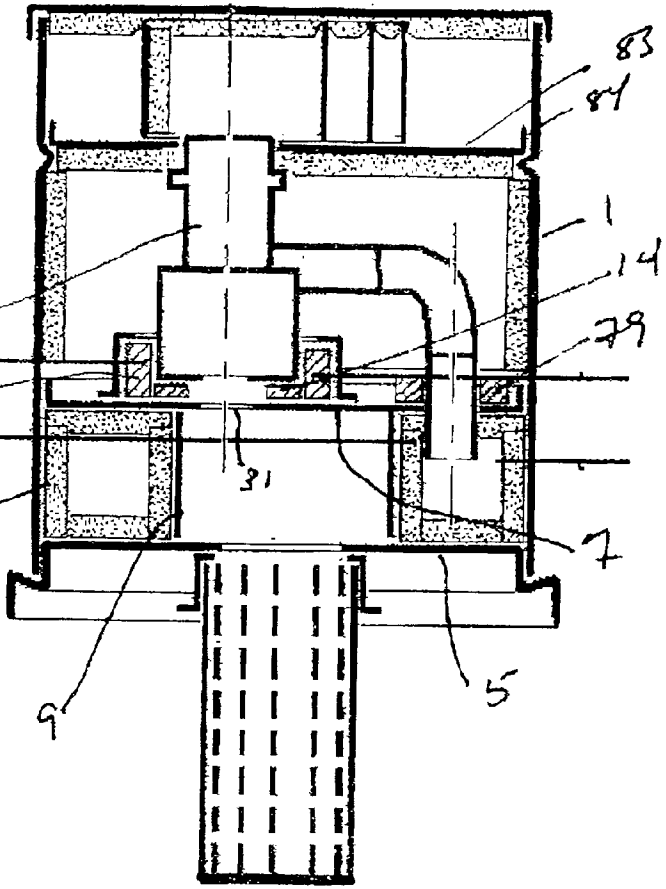
FIGS. 6 and 7 are a schematic transversal view of the canister where the motor-fan assembly is moved vertically together with the piping.
Figure 6:
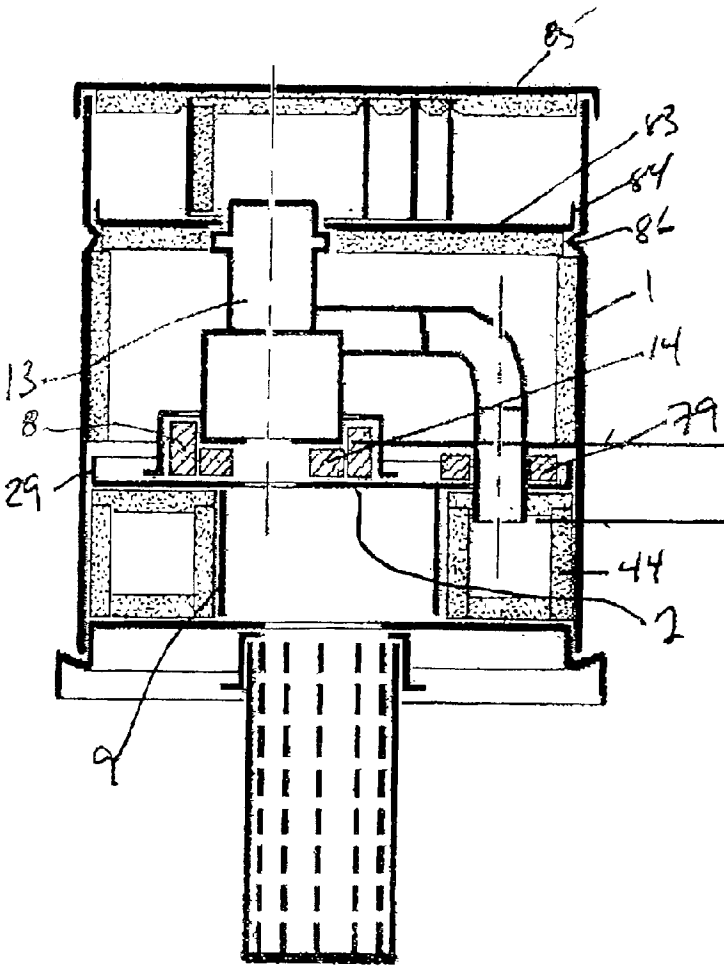

Advantageously, according to a preferred embodiment of the invention, a portion of the piping 73 passes across the second opening 33 of the plate 7 and has a substantially vertical axis substantially parallel to the axis of the intake 69 of the vacuum fan 67. Thus, any deformation of the seat 14 due to the vacuum existing underneath of the motor-fan assembly 13, will allow the piping 77 to slide freely in the second opening 33 without solid contact with said plate 7 In this regard, refer to FIGS. 6 and 7 where it is represented the vertical movement of the motor-fan assembly 13 and piping 73.

Preferably, a sleeve 79 of resilient vibration absorbing material is mounted around the second opening 33 of the second plate 7. This sleeve 79 has an interior of such size and orientation to allow a free axial sliding of said portion of the piping 73 passing across the second opening 33 while substantially preventing leak of working air and noise from the acoustic dampening chamber 43. Advantageously, the interior of the sleeve 79 is smaller than the opening 33 and similar in size to the portion of piping 73 that may slide freely therein.

Advantageously, the sleeve 79 may be mounted on an upper side of said second plate 7 and preferably fixed to said plate 7 by gluing.

Advantageously, as illustrated, the duct means 9 defines a substantially vertical passage between its first end 39 and second end 41. The first end 39 may be substantially co-axial with the first opening 27 of the first plate 5 while the second end 41 is substantially parallel and not aligned with the axis of the first opening 31 of the second plate 7.

Figure 8:
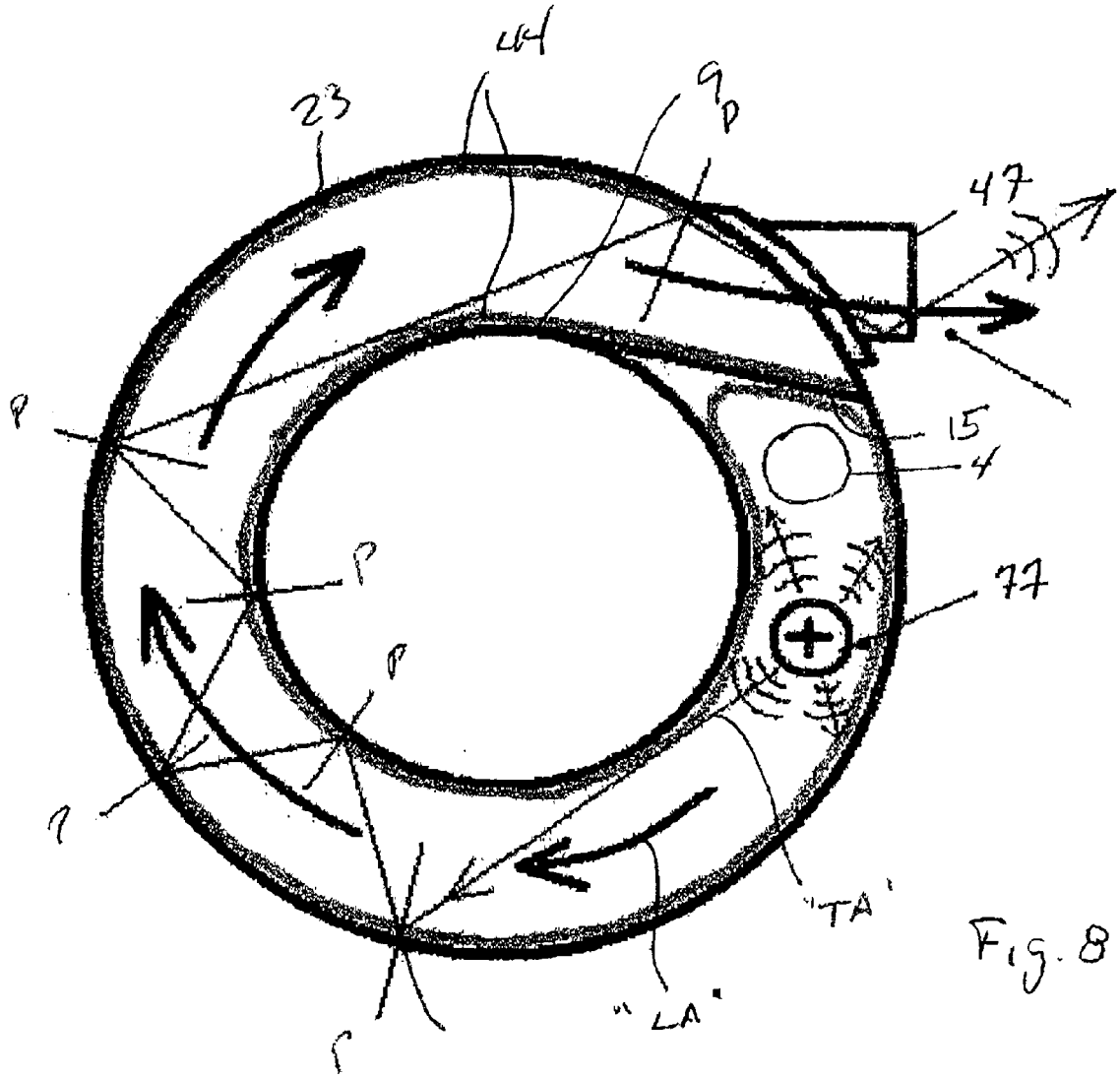
FIG. 8 is a schematic view of the acoustic dampening chamber.
Figure 9:
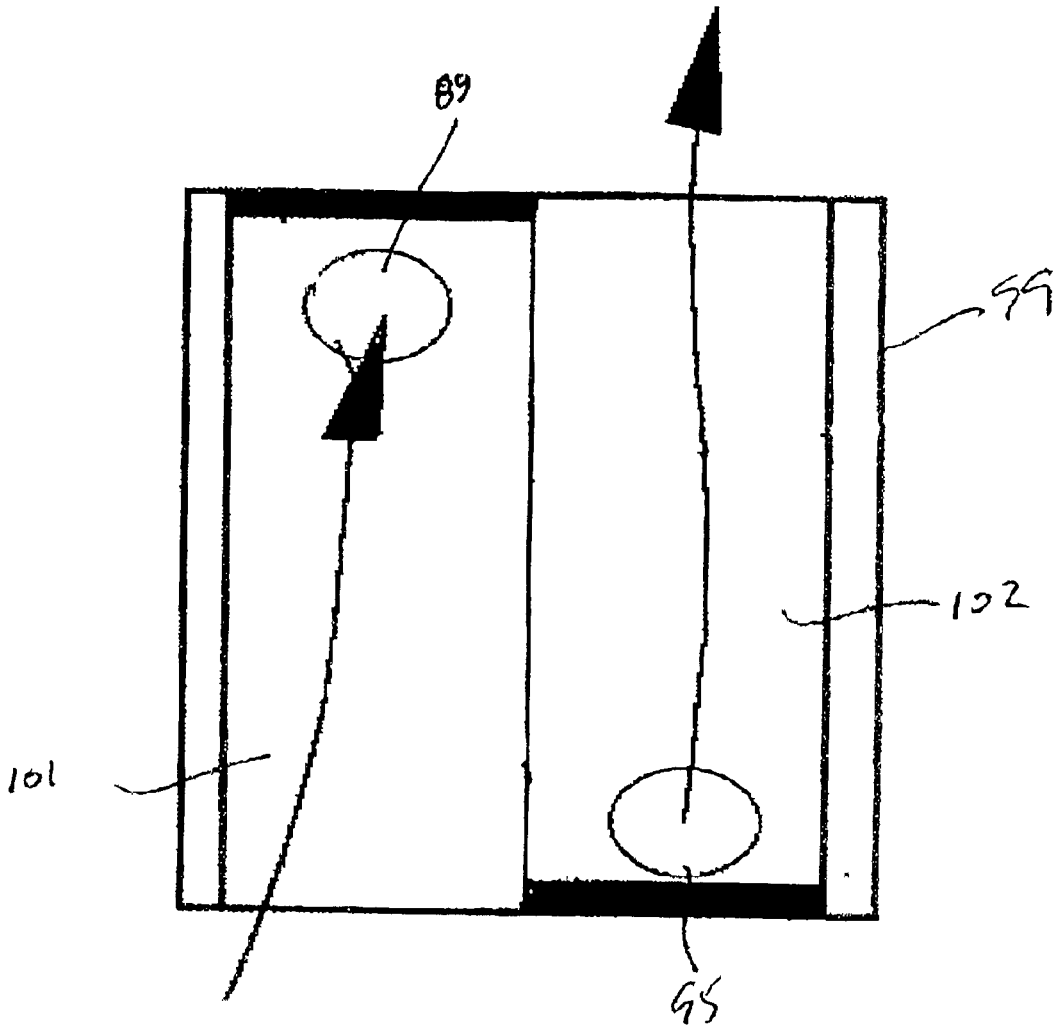
FIG. 9 is a schematic view of the member comprising outer mufflers.

Advantageously, as illustrated in FIG. 8, the air will move according to large arrows "LA" while the noise will move according to thin arrows "TA" and contact a sound absorbing material in several points "P"

Figure 3:
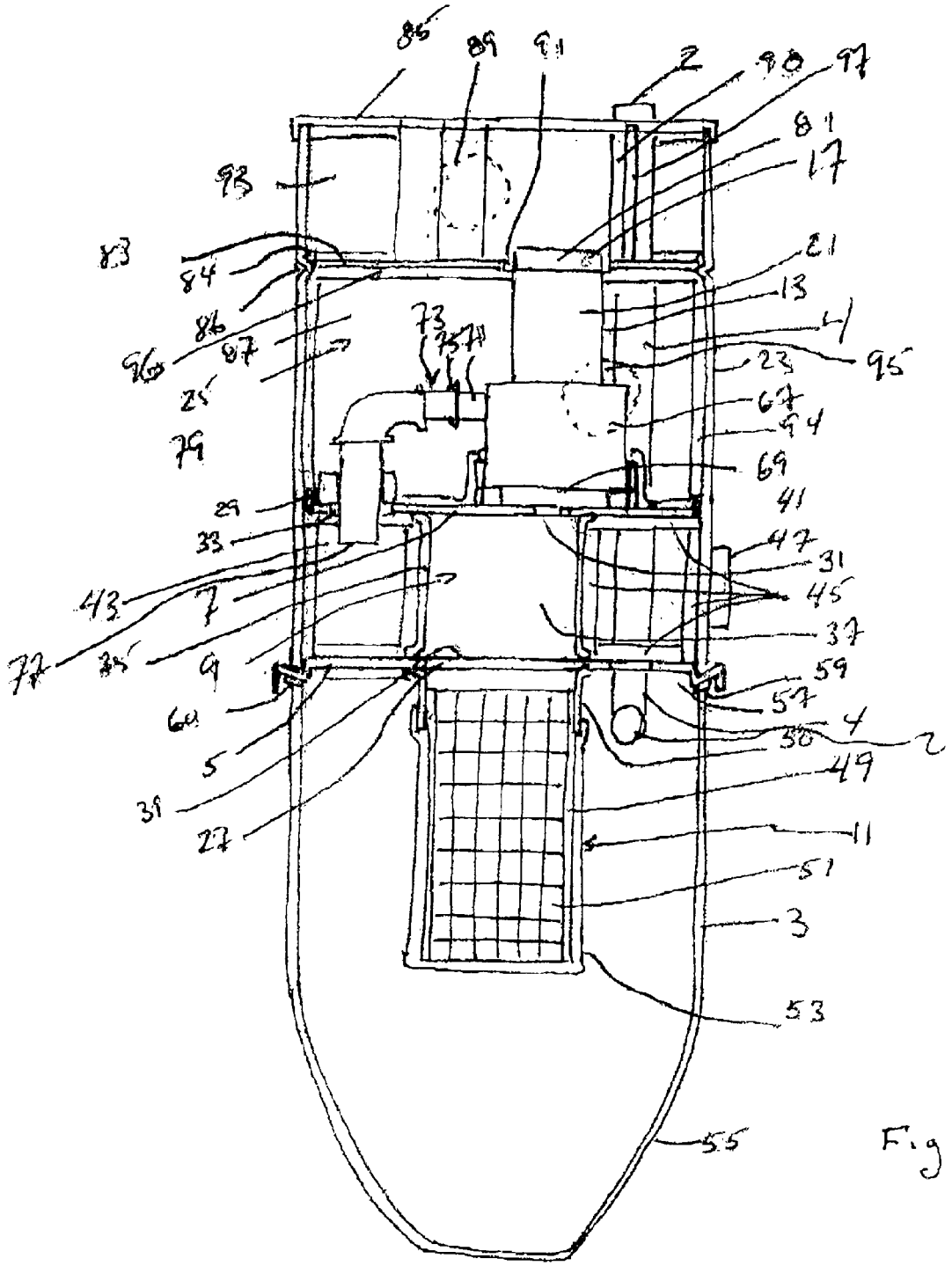
FIG. 3 is a transversal view of the central vacuum power unit of FIG. 1.

The means 17 for generating a flow of cooling air for the electric motor and reducing the emission of noise resulting from the generation of said flow of cooling air, outside the canister 1 may preferably comprise the electric motor 21 which is further provided with a cooling fan 81 forcing a flow of cooling air from one end of the electric motor to an opposite end of said motor. Also, said canister may further comprise a fourth plate 83 extending across the hollow interior 25 of the canister 1 above the second plate 7, and a fifth plate 85 extending across the hollow interior 25 of the canister 1 above the fourth plate 83. The fourth plate 83 and the fifth plate 85 define with the sidewall 23 of the canister, a first chamber 87 in fluid communication with an inlet opening 89 (represented in FIG. 3 only with a dotted line) provided in the sidewall 23 of the canister 1 and defining an inlet for the cooling air for the electric motor and a second opening 91 across which a portion of a casing of said electric motor 21 is engaged The second plate 7 and the fourth plate 83 define with the sidewall 23 of the canister 1 a second chamber 93 for the cooling air coming out the electric motor and evacuated outside the canister through an opening 95 (represented in FIG. 3 only with a dotted line) provided in the sidewall 23 of the canister 1 and in fluid communication with said second chamber 93.

Advantageously, the plate 83 may have a flange 84 to increase its solidity. Preferably, said plate 83 may pe positioned against a rib 86 appearing inside the canister and allowing to position said plate 83 above the plate 7.

Advantageously, a set of second baffle means 97 may be further provided between the inlet opening 89 of the canister 1 and the second opening 91. Preferably, at least a portion of said second baffle means may be provided with a lining 98 of sound absorbing material. Advantageously, the second chamber 93 is further provided with a lining of sound absorbing material. Advantageously, the inlet opening 89 of the second chamber 93 and the outlet of the first chamber 87 are each provided with a muffler (preferably an outer muffler) having its interior provided with a lining of sound absorbing material. Preferably, both mufflers are provided within a hollow member 99 having parallel conduits 101 and 102. The conduit 101 being in fluid communication with the interior of the first chamber 87 while the conduit 102 is in fluid communication with the second chamber 93.

Preferably, the fifth plate 85 defines a cover to said canister 1 and may be advantageously fixed to the canister with small metal screws "S". Advantageously, because of the location of said second baffles means 97, the plate 83 is locked against the rib 86 and the motor-fan assembly is prevented from slipping out of the ring 8 in the eventuality that said central vacuum power unit is reversed during transport.

Preferably, said baffle means, mufflers and lining of sound absorbing material in the second chamber 93 are part of said means reducing the noise resulting from the generation of a flow of air cooling.

Advantageously, the hollow member 99 is firmly fastened to the canister 1 (preferably by any appropriate means such as welding) and may be further provided with means allowing to hang the central power unit to a wall (e.g. a bracket provided with holes in which screws may be inserted).

Figure 4:
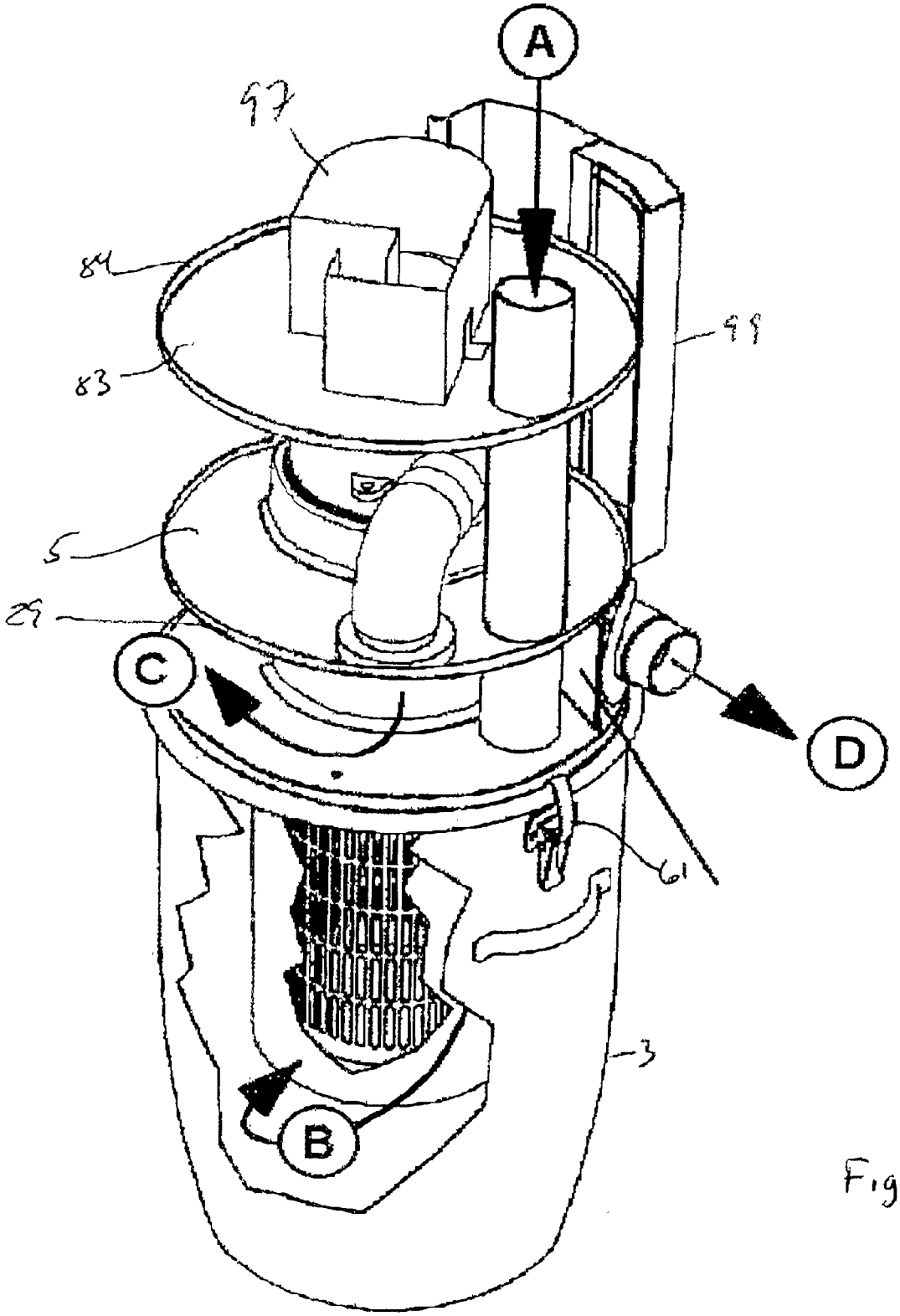
FIGS. 4 and 5 are the perspective view of FIG. 2 with arrows illustrating the air flow for the working air and the cooling air respectively.

Advantageously, a vacuum air intake may be located on the plate 85 (especially the top cover of the canister) and is connected preferably to a PVC tube 4 (preferably a 2 inches diameter PVC tube). The airflow is generated by the motor vacuum air fan which draws air from the intake. Preferably, with reference to FIG. 4, there is a primary airflow path for the working air. The working air containing debris is drawn from the central vacuum air intake (in A) to the debris collecting chamber (B). Said debris are filtered by the filter and this "clean" air is then drawn into the motor vacuum air fan. Said "clean" air is then redirected, by the use of piping, to the substantially annular acoustic dampening chamber (C.) This chamber has preferably on all its surfaces, an acoustic absorbing material that allow for significant noise reduction. Then the airflow is forced to go around the chamber to reach the outlet (D). The acoustic dampening chamber may be further provided with additional baffles to further improve the noise dampening.

Advantageously, an adapter may be preferably placed on the annular chamber exit in older to be able, if desired, to "canalise" air by ducts where desired.

Figure 5:
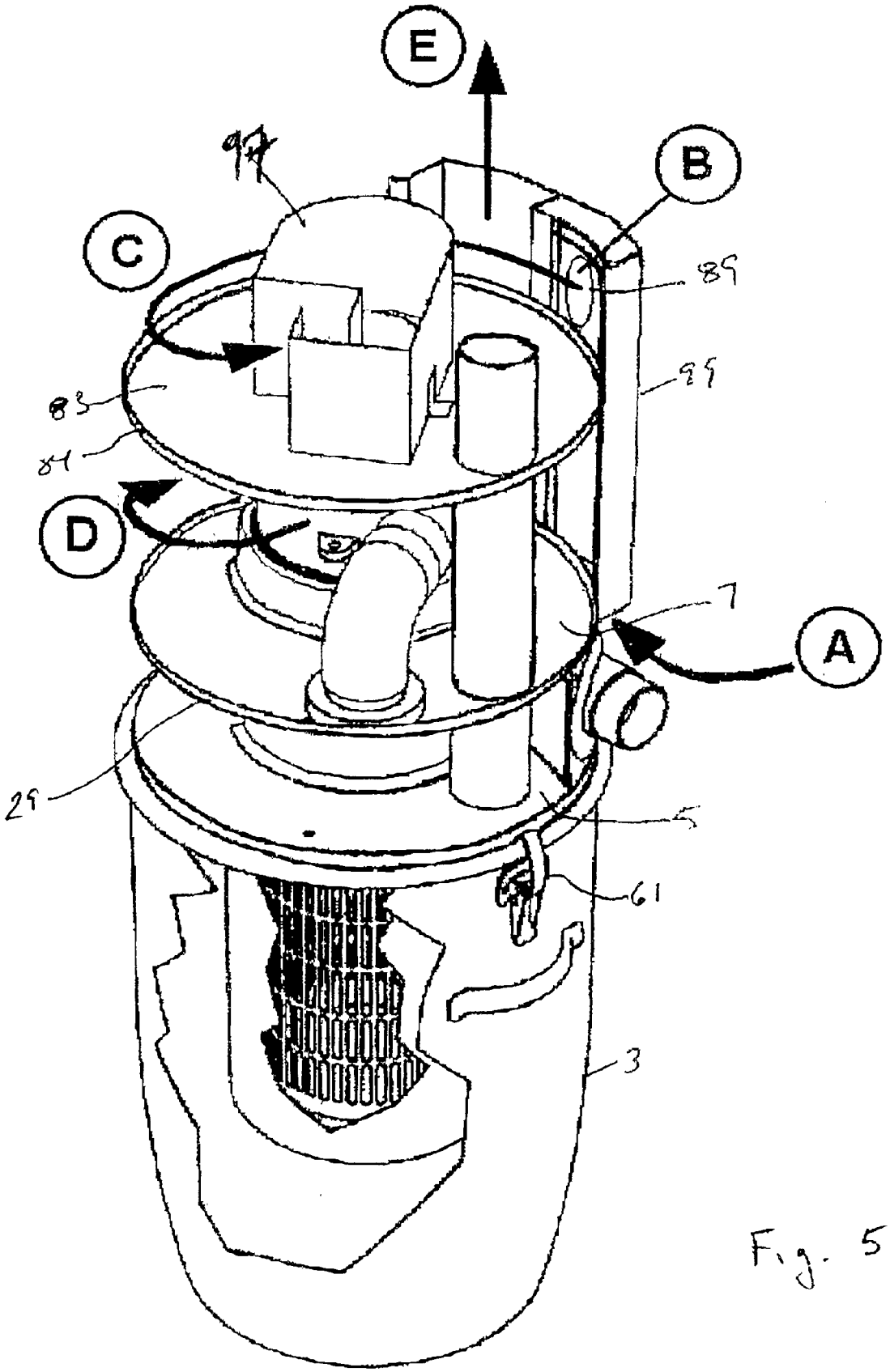

Advantageously, with reference to FIG. 5, the cooling air intake is located at the bottom of the member 99 defining the pair of mufflers. Cooling air enters at the bottom of the conduit 101 of the member 99(in A) and is drawn to the top cooling air chamber and enters this area by the opening 89 (in B). This first canal has acoustical dampening material that absorbs noise generated within the motor cooling air circuit. The cooling air then enters in the motor cooling air intake after passing through by the second baffle means (in C) which may be provided with acoustical dampening material on its surface. Advantageously, the top cover may also have acoustical dampening material on its surface, preferably on its internal surface. The air passes through the motor cooling path to cool the motor. Then the cooling air is rejected by the motor in the chamber 87(In D). Cooling air rejected by the motor enters at the bottom of the acoustical support after going through the opening 95 and finally this air is drawn up through the conduit 102 of the member 99 to the exterior (in E). Conduits 101 and 102 may be further provided with a lining of sound absorbing material.

Preferably, the muffler of the member 99 is intended to lower the noise emitted by the motor.

Alternatively, this member may be provided inside the canister.

Also, the member 99 may be provided with a bracket (not shown) making an integral part of said member (advantageously fixed to the member by welding) and to allow the mounting of the central vacuum power unit to a wall thanks to screws.

Figure 10:
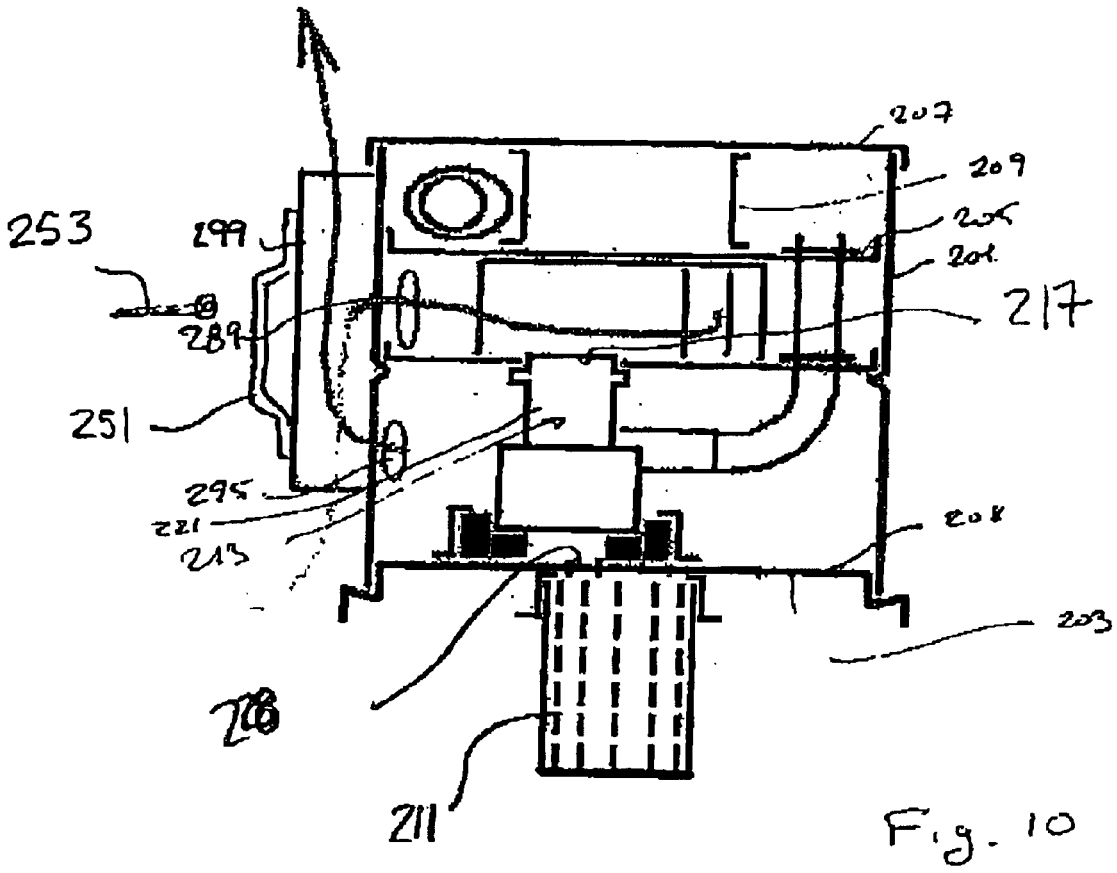
FIG. 10 is a schematic view of an alternative embodiment of the invention.

An alternative embodiment of the particularly preferred central vacuum power unit described hereinbefore, will now be described. In this alternative embodiment, parts that are similar to the one of the previous preferred embodiment will keep the same reference number incremented by 200. According to said alternative embodiment of the invention, the central vacuum power unit may comprise in combination a canister 201, a chamber 203 for collection debris, a first plate 205, a second plate 207, a third plate 208, a duct means 209, a motor fan assembly 213, a filtering means 211, means 217 for generating a flow of cooling air for the electric motor 221 and means for reducing the emission of noises resulting for the generation of said flow of cooling air, outside the canister 201. The third plate 208 extending across the hollow interior and is provided with a first opening 228. As shown in FIG. 10, the canister 201 can be mounted on a wall by means of a hollow member 299 through which the cooling air is drawn before entering into the canister 201. An inlet opening 289 is defined in the canister 201 for receiving the air from the hollow member. The air is evacuated after having cooled the motor via an outlet opening 295. A bracket 251 can be integrally formed with the hollow member 299 for allowing the canister to be mounted on a wall by means of a screw 253.

Advantageously, the sound absorbing material may consist of a 0.5 inch thick polyester urethane fine open-cell foam, especially the one having the trade name is UNIFOAM S82N. UNIFOAM is a registered trademark of BURNETT (WILLIAM T) AND COMPANY Advantageously, the seat 14, the ring 8 and the sleeve 79 are made with a 0.5 thick microcellular polyurethane, *PORON* 4701-50-15. PORON is a registered trademark of ROGERS Corporation, One Technology Drive, PO Box 188, Rogers, Conn. 06263-0188

The present invention is not limited to the preferred embodiments described hereinbefore, and also covers all variations, modifications and variants respecting the essence of the invention

MEASUREMENT REPORT

Sound Power Measurement of Duo Vac Central Vacuum Cleaner <<Silentium>> and Several Other Central Vacuum Power Units Object The objective of this measurement campaign is to rigorously evaluate and compare the acoustic performance of the power unit of several central vacuum units. The Sound Power Level of the Duo Vac <<Silentium>> is measured and compared to several other brands of central vacuum power unit.

Measurement Method

The measurement method used is based on the measurement of Sound Power level $L_w$ using the intensity technique following the recommendations of the standard ISO 9614-2 (1996) (Determination of sound power levels of noise sources using sound intensity—Part 2: Measurement by scanning).

Measurement Conditions

The noise levels have been measured in three different typical installation configurations that are frequently used in practice Configuration 1: Measurement of the sound power radiated by the central vacuum power unit using the ASTM F11,50 07: Standard Test Method for Determining A-Weighted Sound Power Level of Central Vacuum Cleaner Power Unit test configuration intake and exhaust are ducted outside of the testing room.

Configuration 2: Measurement of the sound power radiated by the central vacuum power unit including the noise emitted by the exhaust air An exhaust muffler is used The intake is ducted outside of the testing room.

Configuration 3: Measurement of the sound power radiated by the central vacuum power unit including the noise emitted by the exhaust air without using any exhaust muffler. The intake is ducted outside of the testing room.

Results

| Company | Model | Air Watts Maximum[1] | Configuration 1 $L_w$ dB(A) | Configuration 2 $L_w$ dB(A) | Configuration 3 $L_w$ dB(A) |
|---|---|---|---|---|---|
| North American models - Measurement of Dec. 21, 2000 | | | | | |
| Duo Vac | SIL-1404 (test 1) | 404 | 69.2 | n.a[2] | 73.1 |
| Duo Vac | SIL-1404 (test 2) | 404 | 69.3 | 71.8[3] | 73.3 |
| Duo Vac | SIL-1530 (test 1) | 530 | 69.5 | 70.4[3] | 70.3 |
| Duo Vac | SIL-1530 (test 2) | 530 | 69.6 | 69.7[3] | 69.8 |
| Lindsay | S-2000 | 483 | 74.6 | 76.7[3] | 90.8 |
| Beam | SERENITY 2250 | 530 | 76.8 | 78.2[4] | 86.9 |
| Cyclo Vac | DL-150 | 521 | 77.8 | 79.6[3] | 89.5 |
| Modern Day | SP3 #100SP | 530 | 78.7 | 81.3[3] | 89.8 |
| Vacuflo | 560 | 495 | 79.3 | 80.6[3] | 90.6 |
| European models - Measurement of Jan. 4, 2001 | | | | | |
| Duo Vac | SIL-2562 (test 1) | 562 | 70.1 | 73.4[3] | 72.8 |
| Duo Vac | SIL-2562 (test 2) | 562 | 70.4 | 73.1[3] | 72.1 |
| Duo Vac | SIL-2414 (test 1) | 414 | 70.5 | 73.3[3] | 74.6 |
| Duo Vac | SIL-2414 (test 2) | 414 | 70.9 | 73.9[3] | 75.0 |
| Allaway | CV-1750N | 437 | 71.1 | 72.8[3] | 84.9 |
| Aertecnica | Silver 2000 | 562 | 74.2 | 79.8[4] | 91.3 |
| Univac | MILLENIUM | 455 | 75.1 | 74.2[4] | 80.4 |
| Aldes | AXPIR Compact | 270 | 75.6 | 76.9[4] | 77.3 |
| Flexit | MAKSIMAL | 390 | 77.9 | 78.9[3] | 79.6 |

[1]The technical data (other than acoustic results) disclosed in the following table have been obtained on respective manufacturer's brochures, web site or on the most recent motor manufacturer's available data sheet
[2]Data is not available because of a non-readable file.
[3]With Vaculine ™ 765500 muffler.
[4]With muffler provided by the manufacturer.

What is claimed is:

1. A central vacuum power unit comprising:

a canister having a sidewall and a hollow interior;

a first plate extending across said hollow interior, being mounted to said sidewall and being provided with a first opening, a second plate extending across the hollow interior and being provided with a first opening, a duct means having a sidewall, a hollow interior, a first end and a second end, the first end being mounted on the first plate and having the hollow interior of said duct means in fluid communication with the first opening of the first plate, the second end being mounted to the second plate and having the hollow interior of the duct means in fluid communication with the first opening of said second plate, said duct means supporting the second plate above the first plate, the first plate and the second plate defining with the sidewall of the canister and the sidewall of the duct means an acoustic chamber, said acoustic chamber being further provided with a lining of sound absorbing material and an outlet in the sidewall of the canister, a motor-fan assembly within said canister and emitting noises and vibrations, said motor-fan assembly having an outlet connected to a pipe which is in turn connected in fluid flow communication within said acoustic chamber.

2. The central vacuum power unit according to claim 1, wherein exhausted working air from the motor-fan assembly is blown downwardly below the motor-fan assembly via said pipe into said acoustic chamber.

3. The central vacuum power unit according to claim 1, wherein the motor-fan assembly is further provided with a cooling fan forcing a flow of cooling air from one end of the motor fan assembly to an opposite end thereof, and wherein said motor-fan assembly is located between said second plate and a third plate, the second plate and the third plate defining with the sidewall of the canister a second acoustic chamber around said motor-fan assembly, said motor-fan assembly exhausting the cooling air into said second acoustic chamber along which the cooling air has to flow before being vented outside of the canister through an outlet opening.

4. The central vacuum power unit according to claim 3, wherein said canister is provided with a wall mounting bracket, and wherein said wall mounting bracket defines a conduit in fluid flow communication with said outlet opening.

5. A central vacuum power unit comprising in combination:

a canister having a sidewall, a hollow interior and a debris collection chamber provided with an inlet for receiving working air loaded with debris;

a first plate extending across said hollow interior, being mounted to said sidewall and being provided with a first opening, a second plate extending across the hollow interior, being provided with a first opening and a second opening, a duct means having a sidewall, a hollow interior, a first end and a second end, the first end being mounted on the first plate and having the hollow interior of said duct means in fluid communication with the first opening of the first plate, the second end being mounted to the second plate and having the hollow interior of the duct means in fluid communication with the first opening of said second plate, said duct means supporting the second plate above the first plate, the first plate and the second plate defining with the sidewall of the canister and of the duct means an acoustic damping chamber, said acoustic damping chamber being further provided with a lining of sound absorbing material and an outlet in the sidewall of the canister;

filtering means positioned between the debris collection chamber and the duct means;

a motor-fan assembly emitting noises and vibrations, resting freely against a seat made of resilient vibration absorbing material and mounted on the second plate around the first opening of said second plate; said motor-fan assembly comprising an electric motor, a vacuum fan provided with an axial intake in fluid communication with the first opening of the second plate, a tangential outlet and a piping having a first end in fluid communication with said tangential outlet, and a second end in fluid communication with the inside of the acoustic damping chamber; said motor-fan assembly generating a flow of working air from the inlet of the debris collection chamber to the outlet of the acoustic damping chamber;

means for generating a flow of cooling air for the electric motor and reducing the emission of noises outside the canister;

wherein a portion of said piping extends through the second opening of the second plate and has a vertical axis substantially parallel to the axis of the intake of the vacuum fan, so that any deformation of the seat due to the vacuum existing underneath the motor-fan assembly will allow the piping to slide freely in the second opening of the second plate without directly contacting said second plate.

6. The central vacuum power unit according to claim 5, wherein a pathway between the outlet of the piping and the outlet of the acoustic damping chamber extends along a portion of a circle.

7. The central vacuum power unit according to claim 6, wherein said pathway is substantially annular.

8. The central vacuum power unit according to claim 5, wherein the duct means has a substantially vertical passage between its first end and second end, the first end being substantially co-axial with the first opening of the first plate, the second end being parallel and offset with respect to the first opening of the second plate.

9. The central vacuum power unit according to claim 5, wherein the acoustic damping chamber and first baffle means are completely provided with a lining of sound absorbing material.

10. The central vacuum power unit according to claim 5, wherein a sleeve of resilient vibration absorbing material is mounted around the second opening of the second plate, said sleeve having an interior of such size and orientation to allow a free axial sliding of said portion of the piping passing across the second opening of said second plate while substantially preventing leak of working air from the acoustic damping chamber.

11. The central vacuum power unit according to claim 10, wherein said sleeve is mounted on an upper side of said second plate.

12. The central vacuum power unit according to claim 11, wherein said sleeve is mounted by gluing.

13. The central vacuum power unit according to claim 5, wherein the electric motor is further provided with a cooling fan forcing a flow of cooling air from one end of the electric motor to an opposite end of said motor, and wherein said canister comprise a fourth plate extending across the hollow interior of the canister above the second plate, and a fifth plate extending across the hollow interior of the canister above the fourth plate, the fourth plate and the fifth plate defining with the sidewall of the canister a first chamber in fluid communication with a first opening provided in the sidewall of the canister and defining an inlet for the cooling air for the electric motor and a second opening across which a portion of a casing of said electric motor is engaged, the second plate and the fourth plate defining with the sidewall of the canister a second chamber for the cooling air coming out the electric motor and evacuated outside the canister through an opening provided in the sidewall of the canister and in fluid communication with said second chamber.

14. The central vacuum power unit according to claim 13, wherein a set of baffles is provided between the inlet opening of the canister and the second opening of the fourth plate.

15. The central vacuum power unit according to claim 14, wherein said baffles are provided with a lining of sound absorbing material.

16. The central vacuum power unit according to claim 13, wherein the second chamber is provided with a lining of sound absorbing material.

17. The central vacuum power unit according to claim 13 wherein the inlet of the first chamber and the outlet of the second chamber are each provided with an outer muffler provided with a lining of sound material therein.

18. The central vacuum power unit according to claim 17, wherein both mufflers are provided in a hallow member having parallel conduits, each conduit being in fluid communication with the exterior of the canister at opposite ends of said member, and being respectively in fluid communication with the inlet of the first chamber and the outlet of the second chamber.

19. The central vacuum power unit according to claim 18 wherein said hollow member further defines means for hanging the central vacuum power unit to a wall.

20. A central vacuum power unit comprising:

a canister having a sidewall forming a hollow interior, first and second plates extending across said hollow interior, a central duct extending between said first and second plates, said central duct being in fluid flow communication at opposite ends thereof with respective openings defined in said first and second plates, said first and second plates defining with the sidewall of said canister an acoustic chamber about said central duct, an outlet for exhausting air therefrom, and a motor-fan assembly within said canister, said motor-fan assembly having an outlet connected in fluid flow communication with said acoustic chamber.

* * * * *